US008326606B2

(12) United States Patent
Oshikiri

(10) Patent No.: US 8,326,606 B2
(45) Date of Patent: Dec. 4, 2012

(54) SOUND ENCODING DEVICE AND SOUND ENCODING METHOD

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1511 days.

(21) Appl. No.: 11/577,638

(22) PCT Filed: Oct. 25, 2005

(86) PCT No.: PCT/JP2005/019578

§ 371 (c)(1),
(2), (4) Date: Apr. 20, 2007

(87) PCT Pub. No.: WO2006/046546

PCT Pub. Date: May 4, 2006

(65) Prior Publication Data

US 2008/0065373 A1 Mar. 13, 2008

(30) Foreign Application Priority Data

Oct. 26, 2004 (JP) ..... 2004-311143

(51) Int. Cl.
*G10L 19/00* (2006.01)
*G10L 19/02* (2006.01)

(52) U.S. Cl. ..... 704/200.1; 704/203; 704/204; 704/230; 704/500

(58) Field of Classification Search ..... 704/500–504
See application file for complete search history.

(56) References Cited

U.S. PATENT DOCUMENTS 5,285,498 A 2/1994 Johnston
5,414,795 A * 5/1995 Tsutsui et al. ..... 704/204

(Continued)

FOREIGN PATENT DOCUMENTS

EP 0559383 9/1993

(Continued)

OTHER PUBLICATIONS

Bosi et al., "ISO/IEC MPEG-2 Advanced Audio Coding", Journal of the Audio Engineering Society, Audio Engineering Society, New York, NY, US, vol. 45. No. 10, Oct. 1997, pp. 789-812, XP000730161.
Japan Office action, mail date is Mar. 27, 2012.
English language Abstract of JP 6-268608, Sep. 22, 1994.
English language Abstract of JP 2003-66998, Mar. 5, 2003.

(Continued)

*Primary Examiner* — Pierre-Louis Desir
*Assistant Examiner* — Matthew Baker
(74) *Attorney, Agent, or Firm* — Greenblum & Bernstein, P.L.C.

(57) ABSTRACT

A sound encoding device enabling the amount of delay to be kept small and the distortion between frames to be mitigated. In the sound encoding device, a window multiplication part (211) of a long analysis section (21) multiplies a long analysis frame signal of analysis length M1 by an analysis window, the resultant signal multiplied by the analysis window is outputted to an MDCT section (212), and the MDCT section (212) performs MDCT of the input signal to obtain the transform coefficients of the long analysis frame and outputs it to a transform coefficient encoding section (30). The window multiplication part (221) of a short analysis section (22) multiplies a short analysis frame signal of analysis length M2 (M2<M1) by an analysis window and the resultant signal multiplied by the analysis window is outputted to the MDCT section (222). The MDCT section (222) performs MDCT of the input signal to obtain the transform coefficients of the short analysis frame and outputs it to the transform coefficient encoding section (30). A transform coefficient encoding section (30) encodes these transform coefficients and outputs them.

5 Claims, 14 Drawing Sheets

U.S. PATENT DOCUMENTS

| | | | | |
|---|---|---|---|---|
| 5,481,614 | A * | 1/1996 | Johnston | 381/2 |
| 5,487,086 | A * | 1/1996 | Bhaskar | 375/243 |
| 5,533,052 | A * | 7/1996 | Bhaskar | 375/244 |
| 5,701,389 | A * | 12/1997 | Dorward et al. | 704/203 |
| 5,761,642 | A * | 6/1998 | Suzuki et al. | 704/503 |
| 5,825,320 | A * | 10/1998 | Miyamori et al. | 341/139 |
| 5,839,110 | A * | 11/1998 | Maeda et al. | 704/275 |
| 5,848,391 | A | 12/1998 | Bosi et al. | |
| 6,138,120 | A * | 10/2000 | Gongwer et al. | 1/1 |
| 6,167,093 | A | 12/2000 | Tsutsui et al. | |
| 7,003,448 | B1 * | 2/2006 | Lauber et al. | 704/200.1 |
| 7,315,822 | B2 * | 1/2008 | Li | 704/500 |
| 7,325,023 | B2 * | 1/2008 | Youn | 708/402 |
| 7,386,445 | B2 * | 6/2008 | Ojala | 704/219 |
| 7,930,170 | B2 * | 4/2011 | Chakravarthy et al. | 704/200.1 |
| 2002/0147652 | A1 * | 10/2002 | Gheith et al. | 705/26 |
| 2003/0115052 | A1 * | 6/2003 | Chen et al. | 704/230 |
| 2005/0071402 | A1 * | 3/2005 | Youn | 708/402 |
| 2006/0161427 | A1 * | 7/2006 | Ojala | 704/219 |
| 2008/0065373 | A1 * | 3/2008 | Oshikiri | 704/203 |

FOREIGN PATENT DOCUMENTS

| | | |
|---|---|---|
| EP | 0697665 | 2/1996 |
| EP | 0725493 | 8/1996 |
| JP | 6-268608 | 9/1994 |
| JP | 2000-500247 | 1/2000 |
| JP | 2003-66998 | 3/2003 |
| JP | 2003-216188 | 7/2003 |
| JP | 2004-252068 | 9/2004 |

OTHER PUBLICATIONS

Takehiro Moriya, "Speech Coding", the Institute of Electronics, Information and Communication Engineers, Oct. 20, 1998, pp. 36-38 along with a partial English language translation.

M. Iwadare, et al., "A 128 kb/s Hi-Fi Audio CODEC Based on Adaptive Transform Coding with Adaptive Block size MDCT, " IEEE Journal on Selected Areas in Communications, vol. 10, No. 1, pp. 138-144, Jan. 1992.

U.S. Appl. No. 11/577,424 to Oshikiri, which was filed Apr. 18, 2007.

English language Abstract of JP 2000-500247, Jan. 11, 2000.

* cited by examiner

SOUND ENCODING DEVICE AND SOUND ENCODING METHOD

TECHNICAL FIELD

The present invention relates to a speech encoding apparatus and a speech encoding method.

BACKGROUND ART

In speech encoding, transform encoding whereby a time signal is transformed into a frequency domain and transform coefficients are encoded, can efficiently eliminate redundancy contained in the time domain signal. In addition, in the transform encoding, by utilizing perceptual characteristics represented in the frequency domain, it is possible to implement encoding in which quantization distortion is difficult to be perceived even at a low bit rate.

In transform encoding for the recent years, a transform technique called lapped orthogonal transform (LOT) is often used. In LOT, transform is performed based on an orthogonal function taking into consideration not only the orthogonal components within a block but also the orthogonal components between adjacent blocks. Typical techniques of such transform include MDCT (Modified Discrete Cosine Transform). In MDCT, analysis frames are arranged so that a current analysis frame overlaps previous and subsequent analysis frames, and analysis is performed. At this time, it is only necessary to encode coefficients corresponding to half of the analysis length out of transformed coefficients, so that efficient encoding can be performed by using MDCT. In addition, upon synthesis, the current frame and its adjacent frames are overlapped and added, thereby providing a feature that even under circumstances where different quantization distortions occur for each frame, discontinuity at frame boundaries is unlikely to occur.

Normally, when analysis/synthesis is performed by MDCT, a target signal is multiplied by an analysis window and a synthesis window which are window functions. The analysis window/synthesis window to be used at this time has a slope at a portion to be overlapped with the adjacent frames. The length of the overlapping period (that is, the length of the slope) and a delay necessary for buffering an input frame correspond to the length of a delay occurring by the MDCT analysis/synthesis. If this delay increases in bidirectional communication, it takes time for a response from a terminal to arrive at the other terminal, and therefore smooth conversation cannot be performed. Thus, it is preferable that the delay is as short as possible.

Conventional MDCT will be described below.

When a condition expressed by equation 1 is satisfied, the analysis window/synthesis window to be used in MDCT realizes perfect reconstruction (where distortion due to transform is zero on the assumption that there is no quantization distortion).

$$w_{in}(i)\cdot w_{out}(i)+w_{in}(i+N/2)\cdot w_{out}(i+N/2)=1 \quad (0\le i<N) \qquad \text{(Equation 1)}$$

As a typical window satisfying the condition of equation 1, Non-Patent Document 1 proposes a sine window expressed by equation 2. The sine window is as shown in FIG. 1. When such a sine window is used, side lobes are sufficiently attenuated in the spectrum characteristics of the sine window, so that accurate spectrum analysis is possible.

$$w(i)=\sin\left(\frac{i\pi}{N}\right) \quad (0\le i<N) \qquad \text{(Equation 2)}$$

Non-Patent Document 2 proposes a method of performing MDCT analysis/synthesis using the window expressed by equation 3 as a window satisfying the condition of equation 1. Here, N is the length of the analysis window, and L is the length of the overlapping period. The window expressed by equation 3 is as shown in FIG. 2. When such a window is used, the overlapping period is L, and thus the delay by this window is represented by L. Therefore, the occurrence of the delay can be suppressed by setting overlapping period L short.

$$w(i)=\begin{cases} 0 & 0\le i<\frac{1}{4}N-\frac{1}{2}L \\ \cos\left(\frac{\pi\cdot(i-N/4-L/2)}{2L}\right) & \frac{1}{4}N-\frac{1}{2}L\le i<\frac{1}{4}N+\frac{1}{2}L \\ 1 & \frac{1}{4}N+\frac{1}{2}L\le i<\frac{3}{4}N-\frac{1}{2}L \\ \cos\left(\frac{\pi\cdot(i-3N/4+L/2)}{2L}\right) & \frac{3}{4}N-\frac{1}{2}L\le i<\frac{3}{4}N+\frac{1}{2}L \\ 0 & \frac{3}{4}N+\frac{1}{2}L\le i<N \end{cases} \qquad \text{(Equation 3)}$$

Non-Patent Document 1: Takehiro Moriya, "Speech Coding", the Institute of Electronics, Information and Communication Engineers, Oct. 20, 1998, pp. 36-38

Non-Patent Document 2: M. Iwadare, et al., "A 128 kb/s Hi-Fi Audio CODEC Based on Adaptive Transform Coding with Adaptive Block Size MDCT," IEEE Journal on Selected Areas in Communications, Vol. 10, No. 1, pp. 138-144, January 1992.

DISCLOSURE OF INVENTION

Problems to be Solved by the Invention

When the sine window expressed by equation 2 is used, as shown in FIG. 1, an overlapping period of adjacent analysis frames has a half length of the analysis frame. In this example, the analysis frame length is N, and thus the overlapping period is N/2. Therefore, on the synthesis side, in order to synthesize the signal located at N/2 to N−1, unless information of the subsequent analysis frame is obtained, the signal cannot be synthesized. That is, until the sample value located at (3N/2)−1 is obtained, MDCT analysis cannot be performed on the subsequent analysis frame. Only after the sample at the location of (3N/2)−1 is obtained, MDCT analysis is performed on the subsequent analysis frame, and the signal at N/2 to N−1 can be synthesized using transform coefficients of the analysis frame. Accordingly, when a sine window is used, a delay with a length of N/2 occurs.

On the other hand, when the window expressed by equation 3 is used, discontinuity between frames is likely to occur since overlapping period L is short. When MDCT analysis is performed on each of the current analysis frame and the subsequent analysis frame, and the transform coefficients are quantized, quantization is independently performed, and therefore different quantization distortions occur in the current analysis frame and the subsequent analysis frame. When transform coefficients to which quantization distortion is added are inverse transformed into the time domain, the quantization distortion is added over the entire synthesis frame in the time signal. That is, quantization distortion of the current synthesis frame and quantization distortion of the subsequent synthesis frame occur without correlation. Therefore, when the overlapping period is short, discontinuity of a decoded signal resulting from quantization distortion cannot be sufficiently absorbed in an adjacent portion between synthesis frames, and accordingly, the distortion between the frames is perceived. This tendency markedly appears when overlapping period L is made shorter.

It is therefore an object of the present invention to provide a speech encoding apparatus and a speech encoding method that are capable of suppressing the amount of delay low and alleviating the distortion between frames.

Means for Solving the Problem

A speech encoding apparatus of the present invention adopts a configuration including: a analysis section that performs MDCT analysis on one frame of a time-domain speech signal by both a long analysis length and a short analysis length to obtain two types of transform coefficients in a frequency domain; and an encoding section that encodes the two types of transform coefficients.

Advantageous Effect of the Invention

According to the present invention, it is possible to suppress the amount of delay low and alleviate the distortion between frames.

BEST MODE FOR CARRYING OUT THE INVENTION

Embodiments of the present invention will be described in detail below with reference to the accompanying drawings.

Embodiment 1

Figure 1:
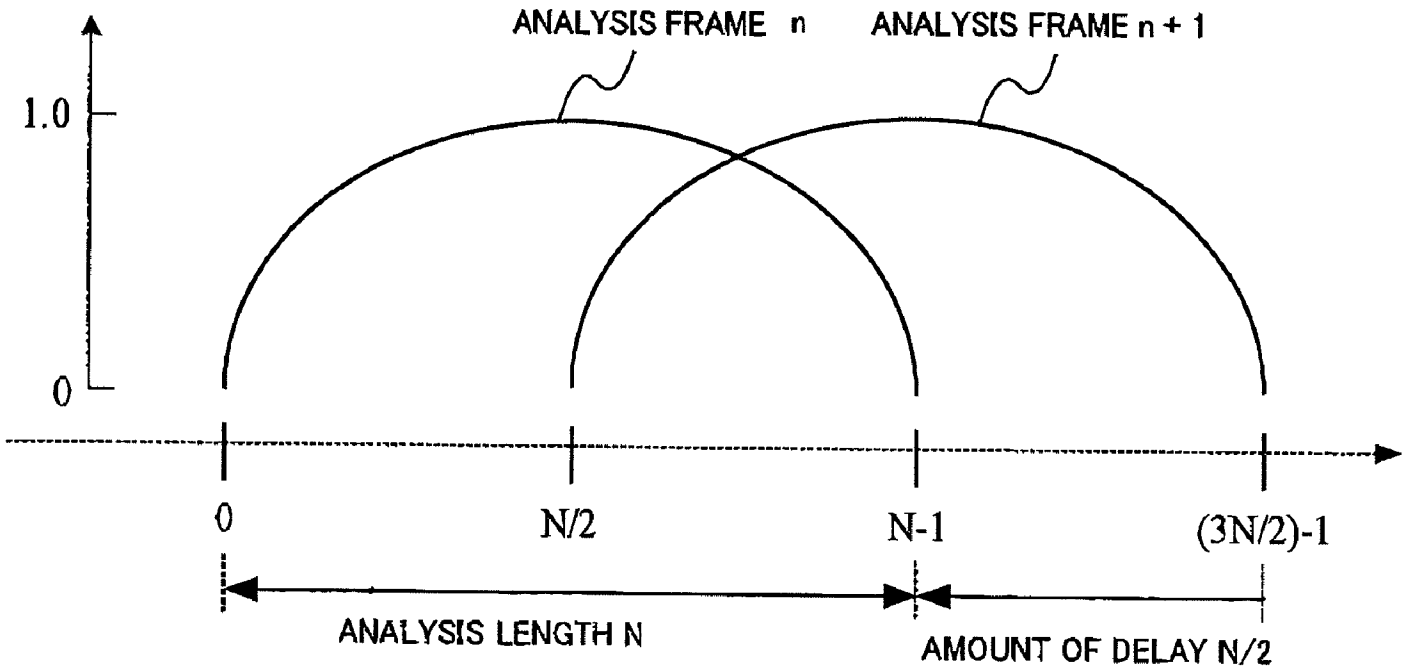
PRIOR ART FIG. 1
FIG. 1 shows a conventional analysis window.
Figure 2:
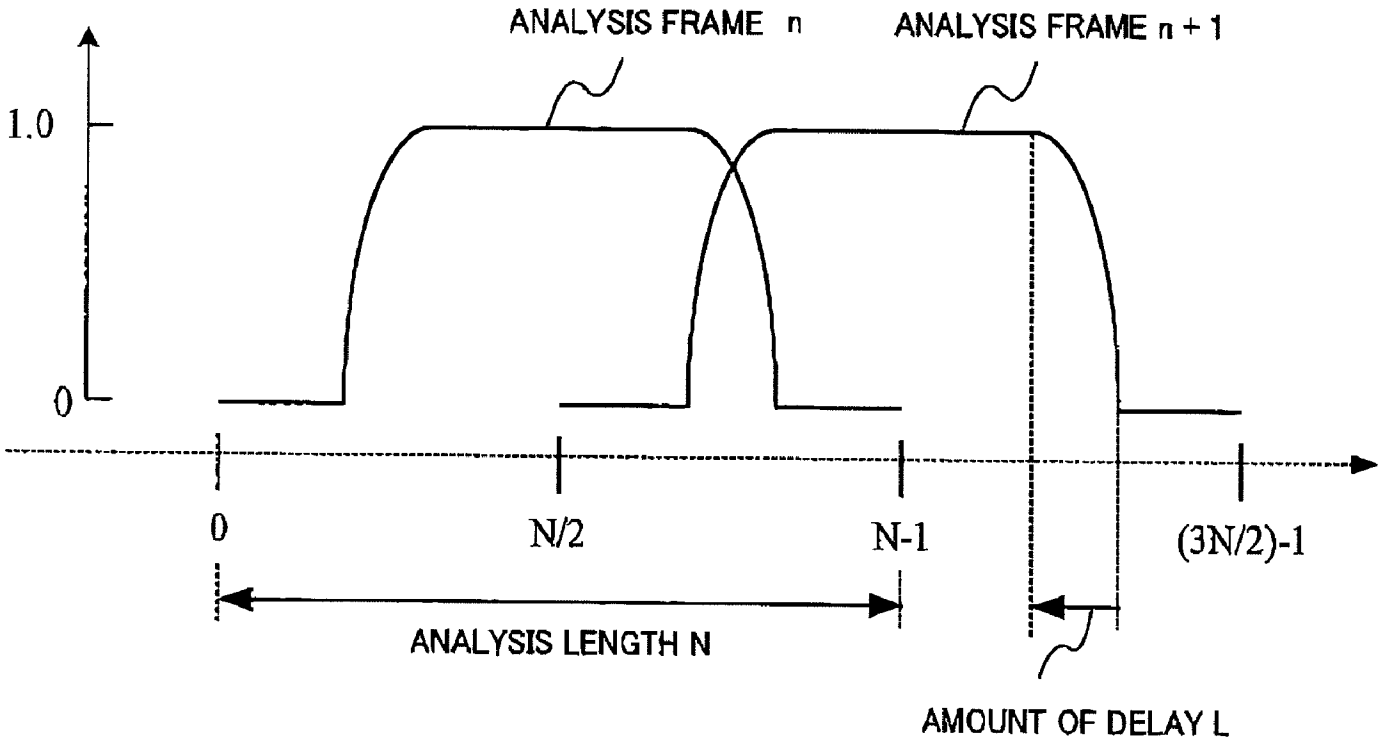
PRIOR ART FIG. 2
FIG. 2 shows a conventional analysis window.
Figure 3:
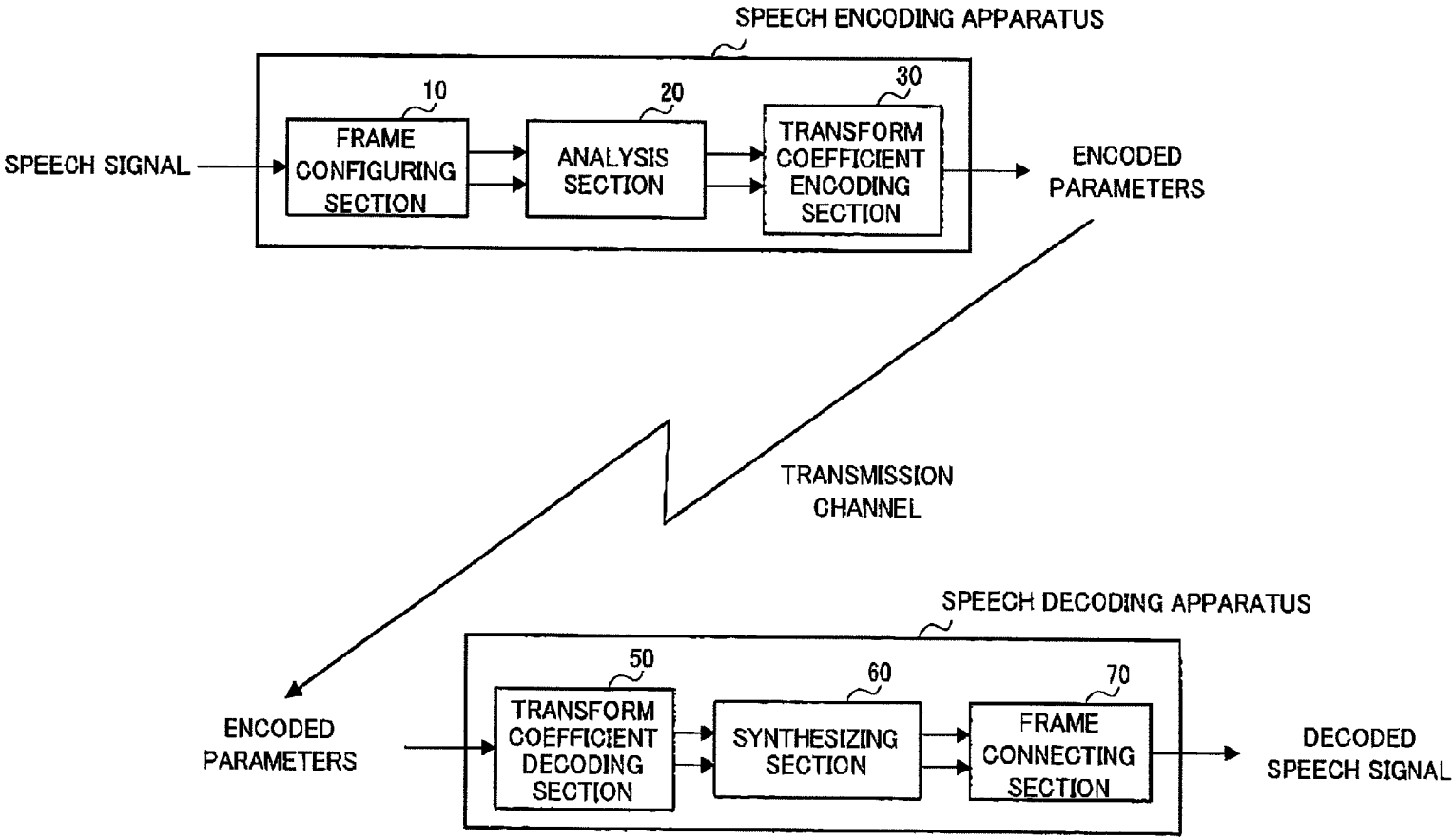
FIG. 3 is a block diagram showing the configurations of a speech encoding apparatus and a speech decoding apparatus according to Embodiment 1 of the present invention.

The configurations of a speech encoding apparatus and a speech decoding apparatus according to Embodiment 1 of the present invention are shown in FIG. 3. As shown in the drawing, the speech encoding apparatus includes frame configuring section 10, analysis section 20 and transform coefficient encoding section 30. The speech decoding apparatus includes transform coefficient decoding section 50, synthesizing section 60 and frame connecting section 70.

In the speech encoding apparatus, frame configuring section 10 forms a time-domain speech signal to be inputted, into frames. Analysis section 20 transforms the time-domain speech signal broken into frames, into a frequency-domain signal by MDCT analysis. Transform coefficient encoding section 30 encodes transform coefficients obtained by analysis section 20 and outputs encoded parameters. The encoded parameters are transmitted to the speech decoding apparatus through a transmission channel.

In the speech decoding apparatus, transform coefficient decoding section 50 decodes the encoded parameters transmitted through the transmission channel. Synthesizing section 60 generates a time-domain signal from decoded transform coefficients by MDCT synthesis. Frame connecting section 70 connects the time-domain signal so that there is no discontinuity between adjacent frames, and outputs a decoded speech signal.

Figure 4:
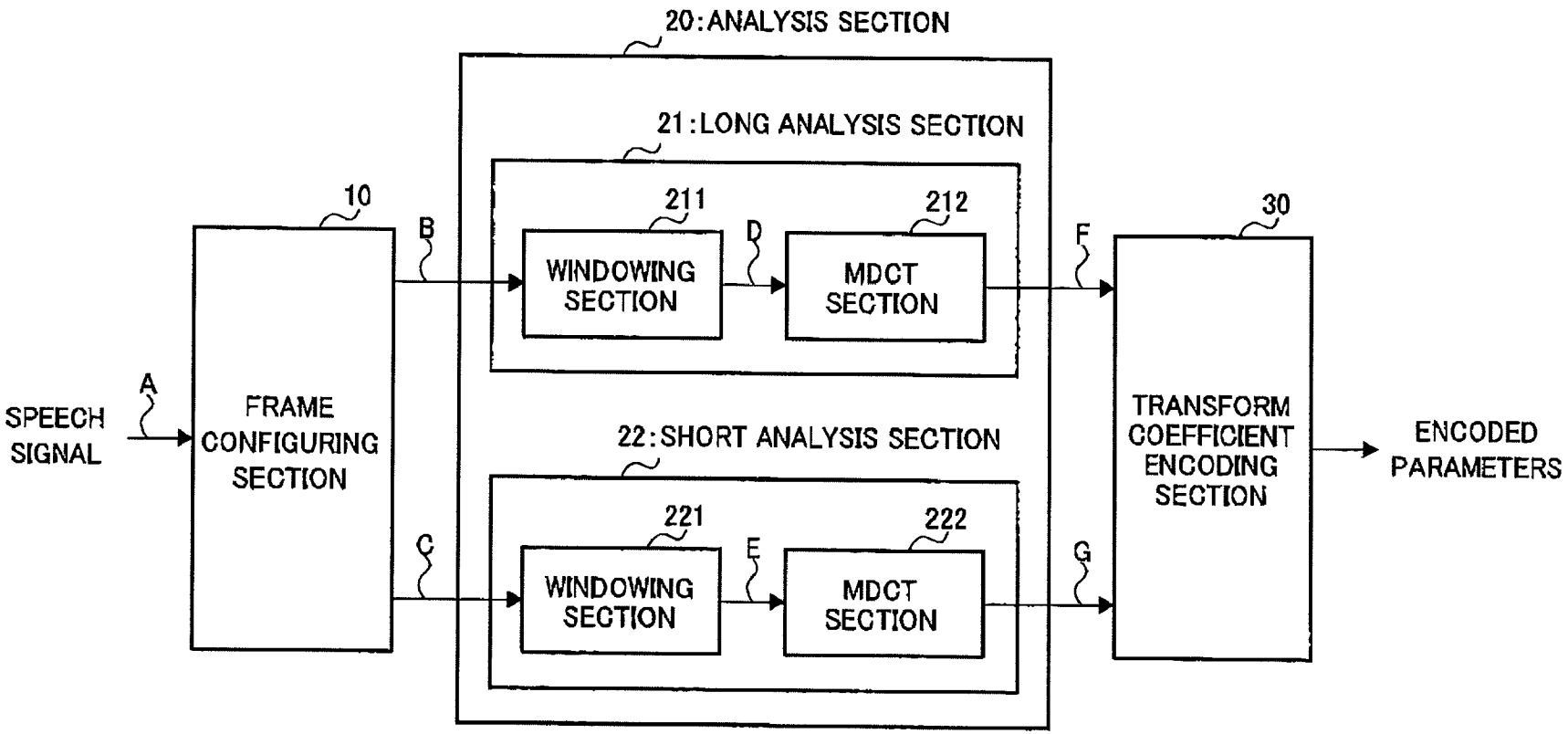
FIG. 4 is a block diagram showing the configuration of the speech encoding apparatus according to Embodiment 1 of the present invention.
Figure 5:
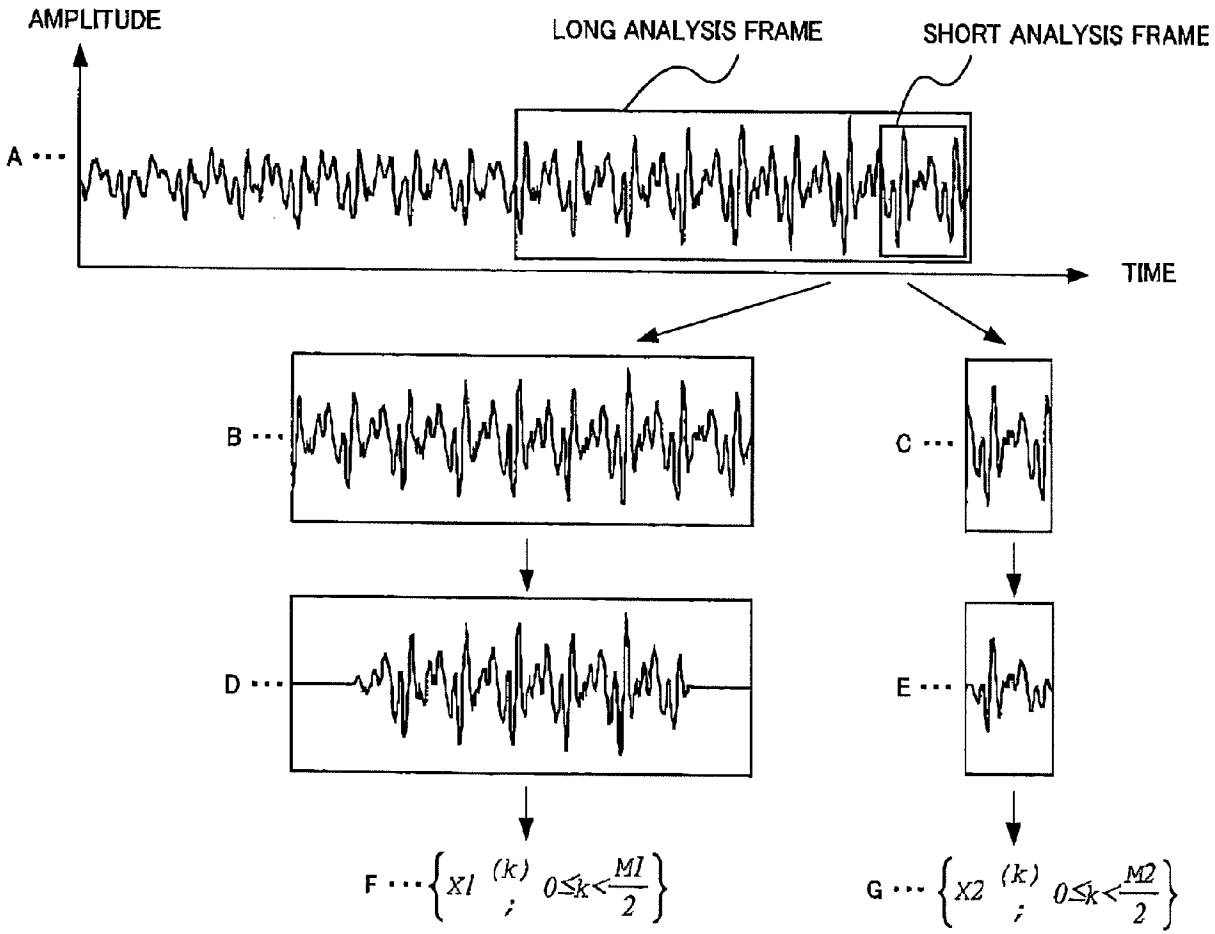
FIG. 5 is a figure of waveforms to explain the signal processing in the encoding apparatus diagram of the speech encoding apparatus according to Embodiment 1 of the present invention.

Next, the speech encoding apparatus will be described in more detail. A more detailed configuration of the speech encoding apparatus is shown in FIG. 4, and a figure of waveforms to explain the signal processing in the encoding apparatus is shown in FIG. 5. Signals A to G shown in FIG. 4 correspond to signals A to G shown in FIG. 5.

When speech signal A is inputted to frame configuring section 10, an analysis frame period for long analysis (long analysis frame) and an analysis frame period for short analysis (short analysis frame) are determined in frame configuring section 10. Then, frame configuring section 10 outputs long analysis frame signal B to windowing section 211 of long analysis section 21 and outputs short analysis frame signal C to windowing section 221 of short analysis section 22. A long analysis frame length (long analysis window length) and a short analysis frame length (short analysis window length) are predetermined, and, here, a description is made with the long analysis frame length being M1 and the short analysis frame length being M2 (M1>M2). Thus, a delay to occur is M2/2.

Figure 6:
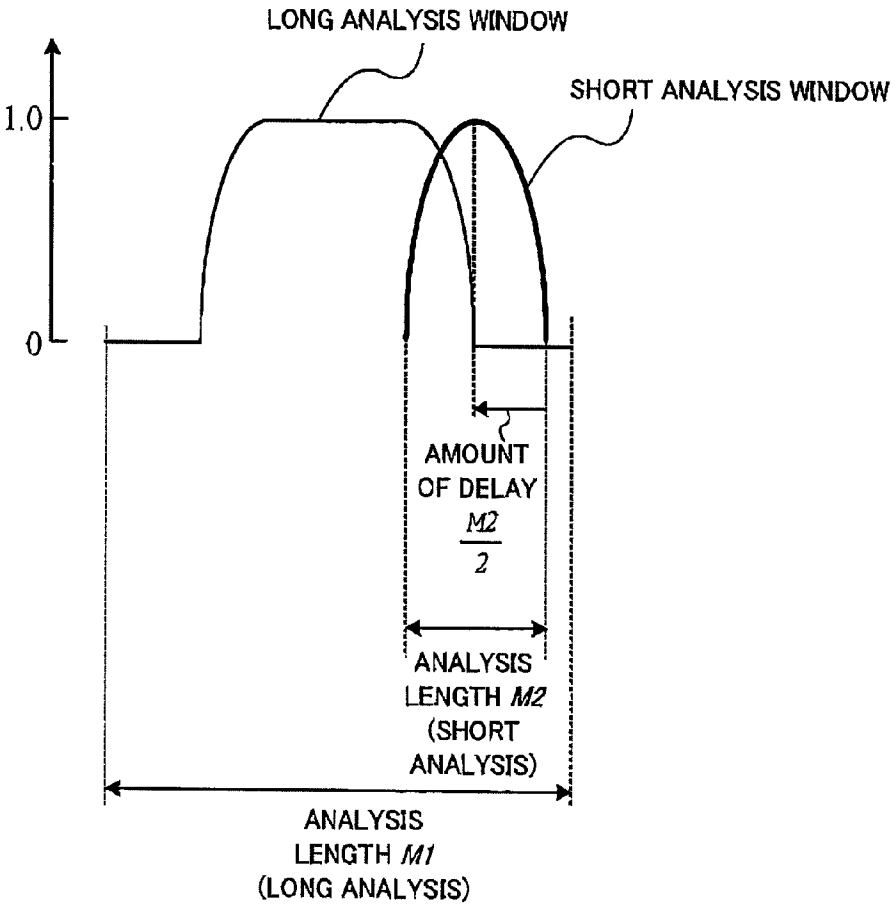
FIG. 6 shows an analysis window according to Embodiment 1 of the present invention.

In long analysis section 21, windowing section 211 multiplies long analysis frame signal B with analysis length (analysis window length) M1 by an analysis window and outputs signal D multiplied by the analysis window to MDCT section 212. As the analysis window, the long analysis window shown in FIG. 6 is used. The long analysis window is designed based on equation 3 with the analysis length being M1 and the overlapping period being M2/2.

MDCT section 212 performs MDCT on signal D according to equation 4. MDCT section 212 then outputs transform coefficients F obtained by the MDCT to transform coefficient encoding section 30. In equation 4, {s1(i); 0≦i≦M1} represents a time signal included in the long analysis frame, and {X1(k); 0≦k<M1/2} represents the transform coefficients F obtained by long analysis.

$$X1(k) = \sqrt{\frac{2}{M1}} \sum_{i=0}^{M1-1} s1(i)\cos\left(\frac{(2i+1+M1/2)(2k+1)\pi}{2\cdot M1}\right) \quad \text{(Equation 4)}$$

On the other hand, in short analysis section 22, windowing section 221 multiplies short analysis frame signal C with analysis length (analysis window length) M2 by an analysis window and outputs signal E multiplied by the analysis window to MDCT section 222. As the analysis window, the short analysis window shown in FIG. 6 is used. The short analysis window is designed based on equation 2 with the analysis length being M2 (M2<M1).

MDCT section 222 performs MDCT on signal E according to equation 5. MDCT section 222 then outputs transform coefficients G obtained by the MDCT to transform coefficient encoding section 30. In equation 5, {s2(i); 0≦i<M2} represents a time signal included in a short analysis frame, and {X2(k); 0≦k<M2/2} represents transform coefficients G obtained by short analysis.

$$X2(k) = \sqrt{\frac{2}{M2}} \sum_{i=0}^{M2-1} s2(i)\cos\left(\frac{(2i+1+M2/2)(2k+1)\pi}{2\cdot M2}\right) \quad \text{(Equation 5)}$$

Transform coefficient encoding section 30 encodes transform coefficients F: {X1(k)} and transform coefficients G: {X2 (k)} and time-division multiplexes and outputs the respective encoded parameters. At this time, transform coefficient encoding section 30 performs more accurate (smaller quantization error) encoding on the transform coefficients {X2(k)} than that performed on the transform coefficients {X1(k)}. For example, transform coefficient encoding section 30 performs encoding on the transform coefficients {X1 (k)} and the transform coefficients {X2 (k)} so that the number of bits to be encoded per transform coefficient for the transform coefficients {X2 (k)} is set to a higher value than the number of bits to be encoded per transform coefficient for the transform coefficients {X1(k)}. That is, transform coefficient encoding section 30 performs encoding so that the quantization distortion of the transform coefficients {X2(k)} is smaller than that of the transform coefficients {X1(k)}. For an encoding method in transform coefficient encoding section 30, the encoding method described in Japanese Patent Application Laid-Open No. 2003-323199, for example, can be used.

Figure 7:
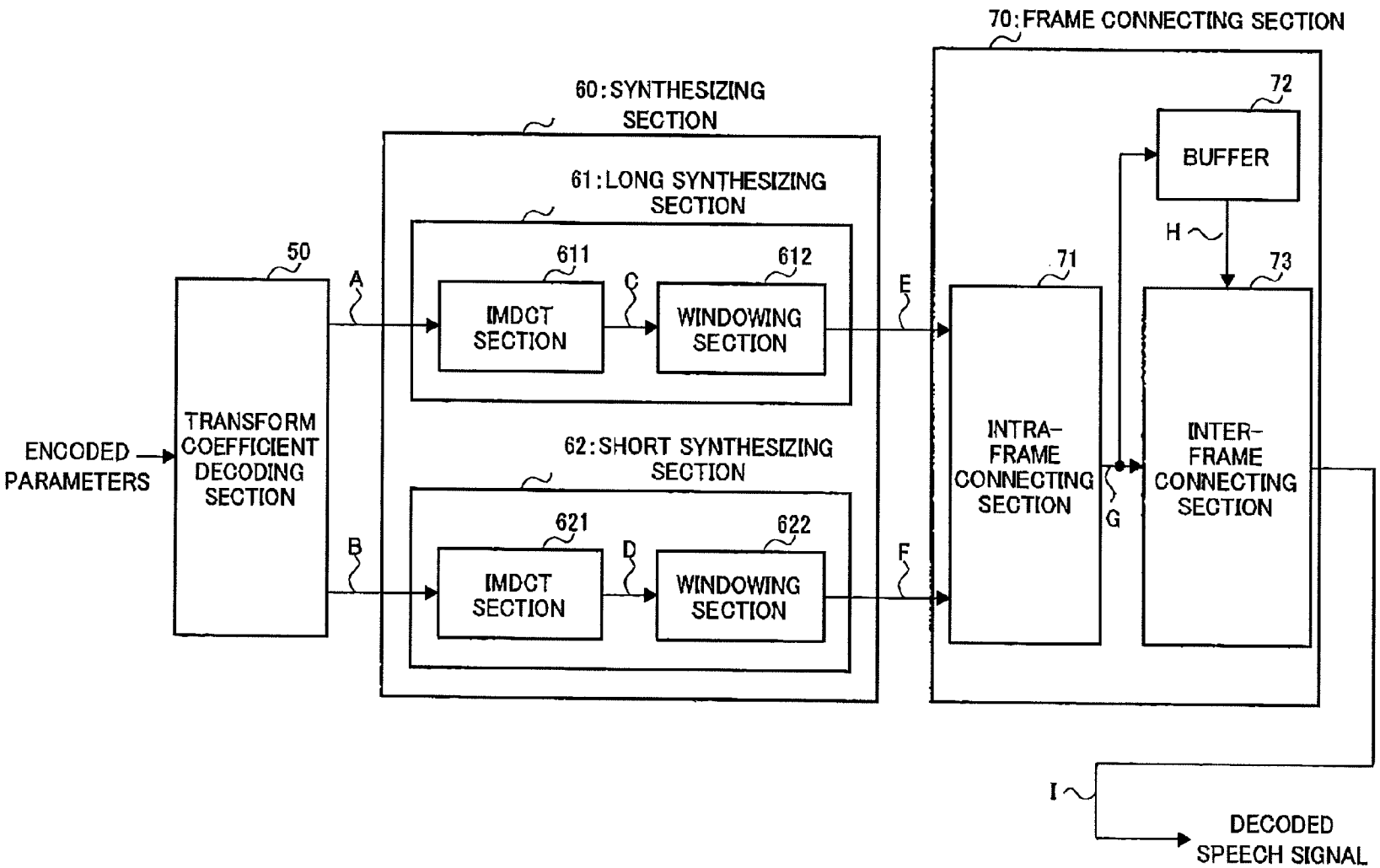
FIG. 7 is a block diagram showing the configuration of the speech decoding apparatus according to Embodiment 1 of the present invention.
Figure 8:
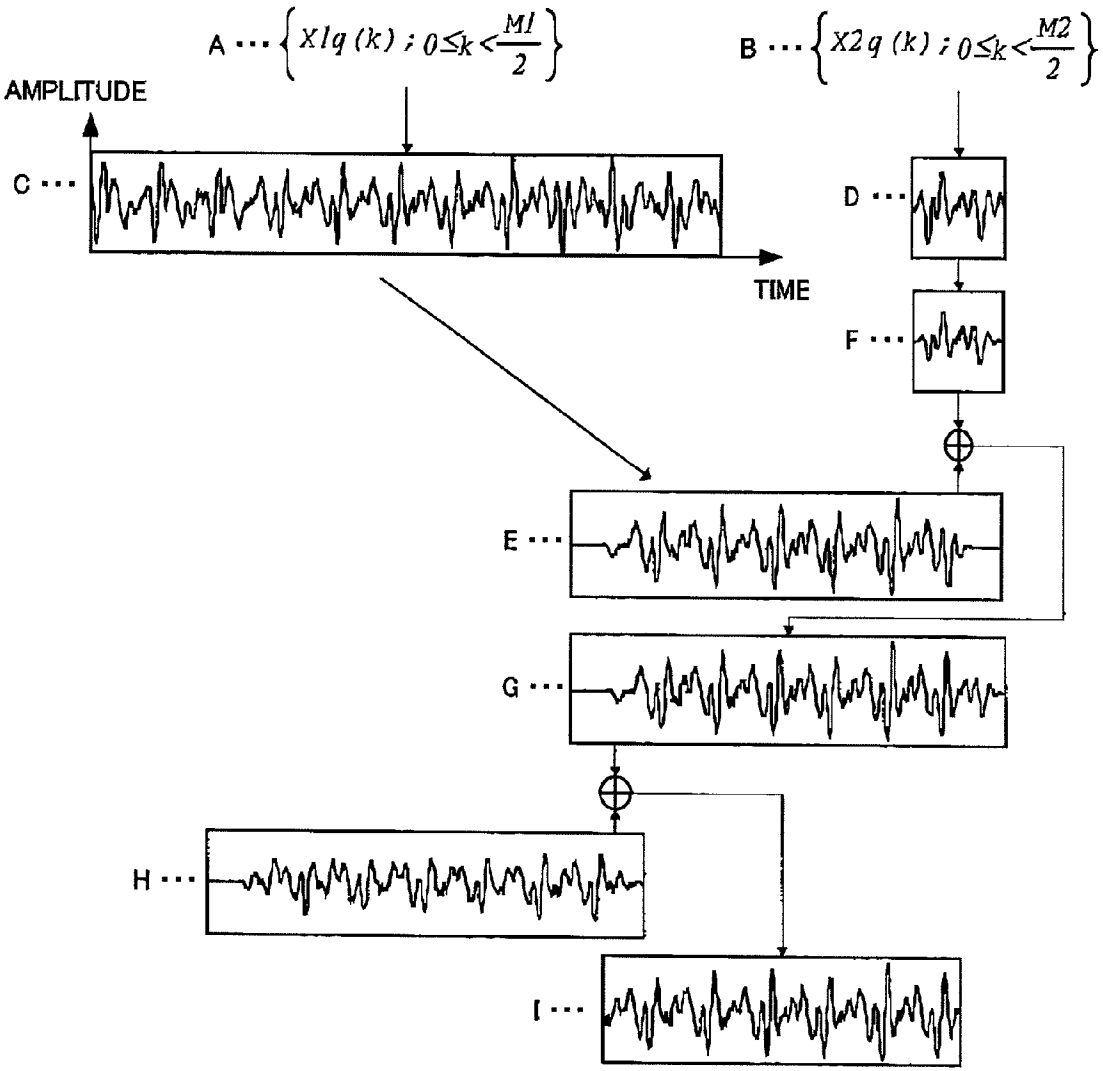
FIG. 8 is a signal state transition diagram of the speech decoding apparatus according to Embodiment 1 of the present invention.

Next, the speech decoding apparatus will be described in more detail. A more detailed configuration of the speech decoding apparatus is shown in FIG. 7, and a signal state transition is shown in FIG. 8. Signals A to I shown in FIG. 7 correspond to signals A to I shown in FIG. 8.

When encoded parameters are inputted to transform coefficient decoding section 50, decoded transform coefficients (long analysis) {X1q(k); 0≦k<M1/2}:A and decoded transform coefficients (short analysis) {X2q(k); 0≦k<M2/2}:B, are decoded in transform coefficient decoding section 50. The transform coefficient decoding section 50 then outputs the decoded transform coefficients {X1q(k)}:A to IMDCT section 611 of long synthesizing section 61 and outputs the decoded transform coefficients {X2q(k)}:B to IMDCT section 621 of short synthesizing section 62.

In long synthesizing section 61, IMDCT section 611 performs IMDCT (inverse transform of MDCT performed by MDCT section 212) on the decoded transform coefficients {X1q(k)} and generates long synthesis signal C, and outputs long synthesis signal C to windowing section 612.

Windowing section 612 multiplies long synthesis signal C by a synthesis window and outputs signal E multiplied by the synthesis window to intra-frame connecting section 71. As the synthesis window, the long analysis window shown in FIG. 6 is used as in windowing section 211 of the speech encoding apparatus.

On the other hand, in short synthesizing section 62, IMDCT section 621 performs IMDCT (inverse transform of MDCT performed by MDCT section 222) on the decoded transform coefficients {X2q(k)} and generates short synthesis signal D, and outputs short synthesis signal D to windowing section 622.

Windowing section 622 multiplies short synthesis signal D by a synthesis window and outputs signal F multiplied by the synthesis window to intra-frame connecting section 71. As the synthesis window, the short analysis window shown in FIG. 6 is used as in windowing section 221 of the speech encoding apparatus.

In intra-frame connecting section 71, decoded signal G of the n-th frame is generated. Then, in inter-frame connecting section 73, periods corresponding to decoded signal G of the n-th frame and decoded signal H of the (n−1)-th frame are overlapped and added to generate a decoded speech signal. Thus, in intra-frame connecting section 71, periods corresponding to signal E and signal F are overlapped and added to generate the decoded signal of the n-th frame {sq(i); 0≦i<M1}:G. Then, in inter-frame connecting section 73, periods corresponding to decoded signal G of the n-th frame and decoded signal H of the (n−1)-th frame buffered in buffer 72 are overlapped and added to generate decoded speech signal I. Thereafter, decoded signal G of the n-th frame is stored in buffer 72 for processing for a subsequent frame ((n+1)-th frame).

Figure 9:
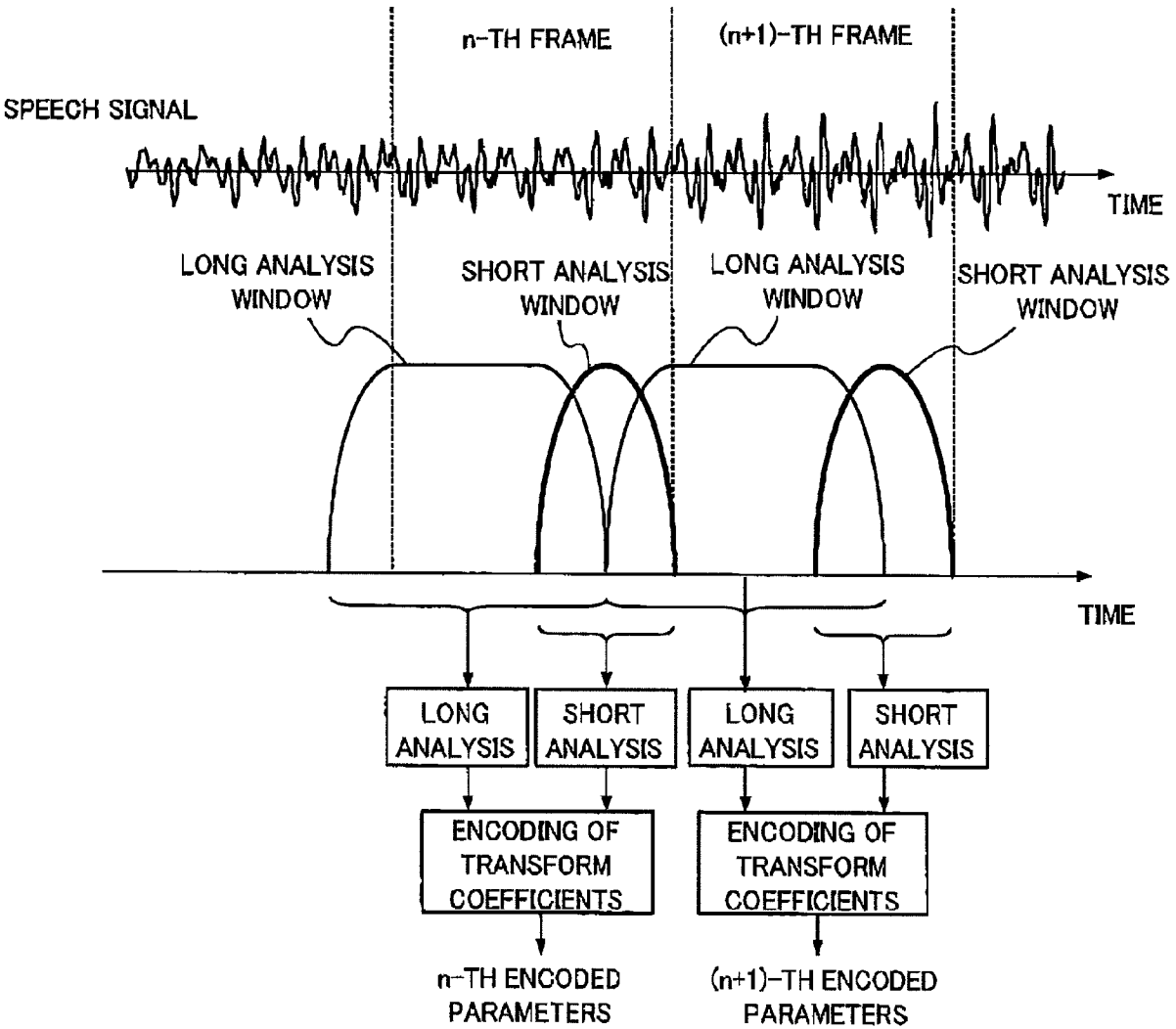
FIG. 9 illustrates operation of the speech encoding apparatus according to Embodiment 1 of the present invention.

Next, the correspondence relationship between the arrangement of frames containing a speech signal and the arrangement of the analysis frames in analysis section 20 is shown in FIG. 9. As shown in FIG. 9, in the present embodiment, analysis of one frame period (a unit for generating encoded parameters) of a speech signal is performed always using a combination of long analysis and short analysis.

As described above, in the present embodiment, MDCT analysis is performed using a combination of a long analysis length (long analysis) and a short analysis length (short analysis), and encoding processing is performed to reduce the quantization error of transform coefficients obtained by short analysis, so that it is possible to efficiently eliminate redundancy by setting a long analysis length where the delay is short and reduce the quantization distortion of the transform coefficients by setting a short analysis. Accordingly, it is possible to suppress the length of delay low to M2/2 and alleviate the distortion between frames.

For the arrangement of a long analysis window and a short analysis window in one frame period, although, in FIG. 6, the short analysis window is arranged temporally after the long analysis window, the long analysis window may be arranged temporally after the short analysis window as shown in FIG.

Figure 10:
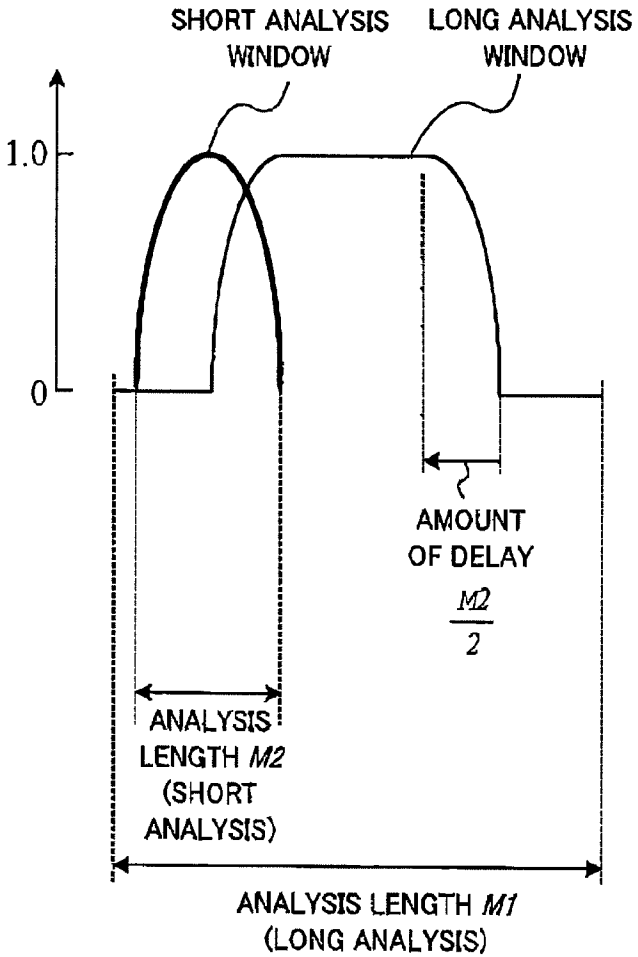
FIG. 10 shows an analysis window according to Embodiment 1 of the present invention.

10, for example. Even with the arrangement shown in FIG. 10, as with the arrangement shown in FIG. 6, the amount of delay can be suppressed low, and the distortion between frames can be alleviated.

Figure 11:
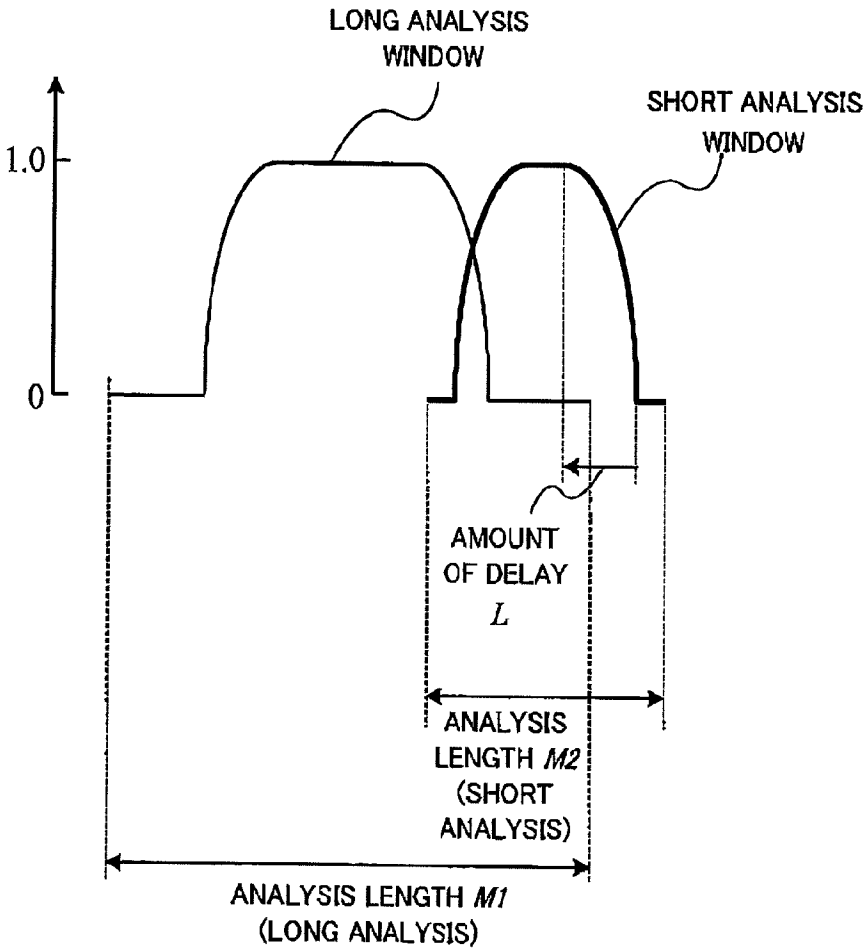
FIG. 11 shows an analysis window according to Embodiment 1 of the present invention.

Although, in the present embodiment, the short analysis window is designed based on equation 2, a window expressed by equation 3 may be used as the short analysis window, provided that the relationship between analysis length M2 of the short analysis window and analysis length M1 of the long analysis window is M2<M1. That is, a window designed based on equation 3 with the analysis length being M2 may be used as the short analysis window. An example of this window is shown in FIG. 11. Even with such an analysis window configuration, the length of delay can be suppressed low, and the distortion between frames can be alleviated.

Embodiment 2

When a speech signal to be inputted to a speech encoding apparatus is a beginning portion of a word or a transition portion where characteristics rapidly change, time resolution is required rather than frequency resolution. For such a speech signal, speech quality is improved by analyzing all analysis frames using short analysis frames.

Figure 12:
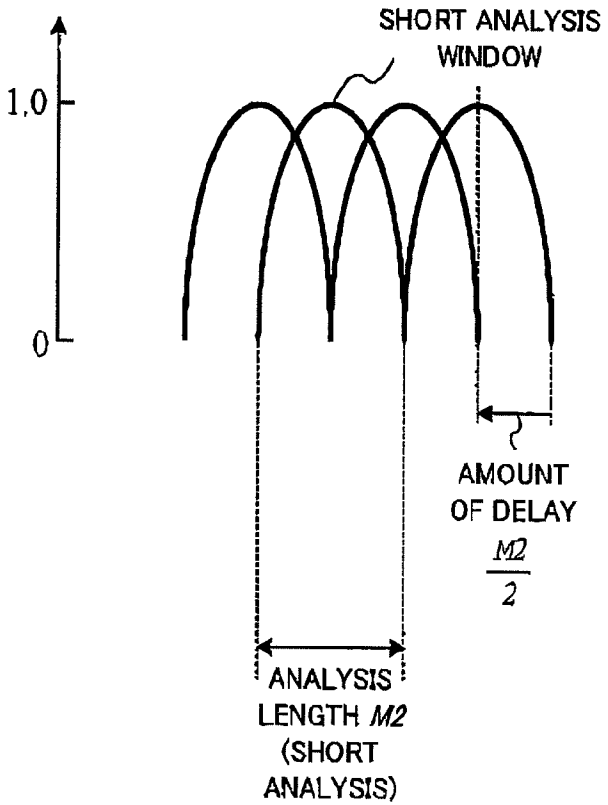
FIG. 12 shows an analysis window according to Embodiment 2 of the present invention.

In view of this, in the present embodiment, MDCT analysis is performed on each frame by switching between (1) a mode (long-short combined analysis mode) in which the analysis is performed by a combination of long analysis and short analysis and (2) a mode (all-short analysis mode) in which short analysis is repeatedly performed a plurality of times, according to the characteristics of the input speech signal. An example of analysis/synthesis windows to be used for each frame in the all-short analysis mode is shown in FIG. 12. The long-short combined analysis mode is the same as that described in Embodiment 1.

Figure 13:
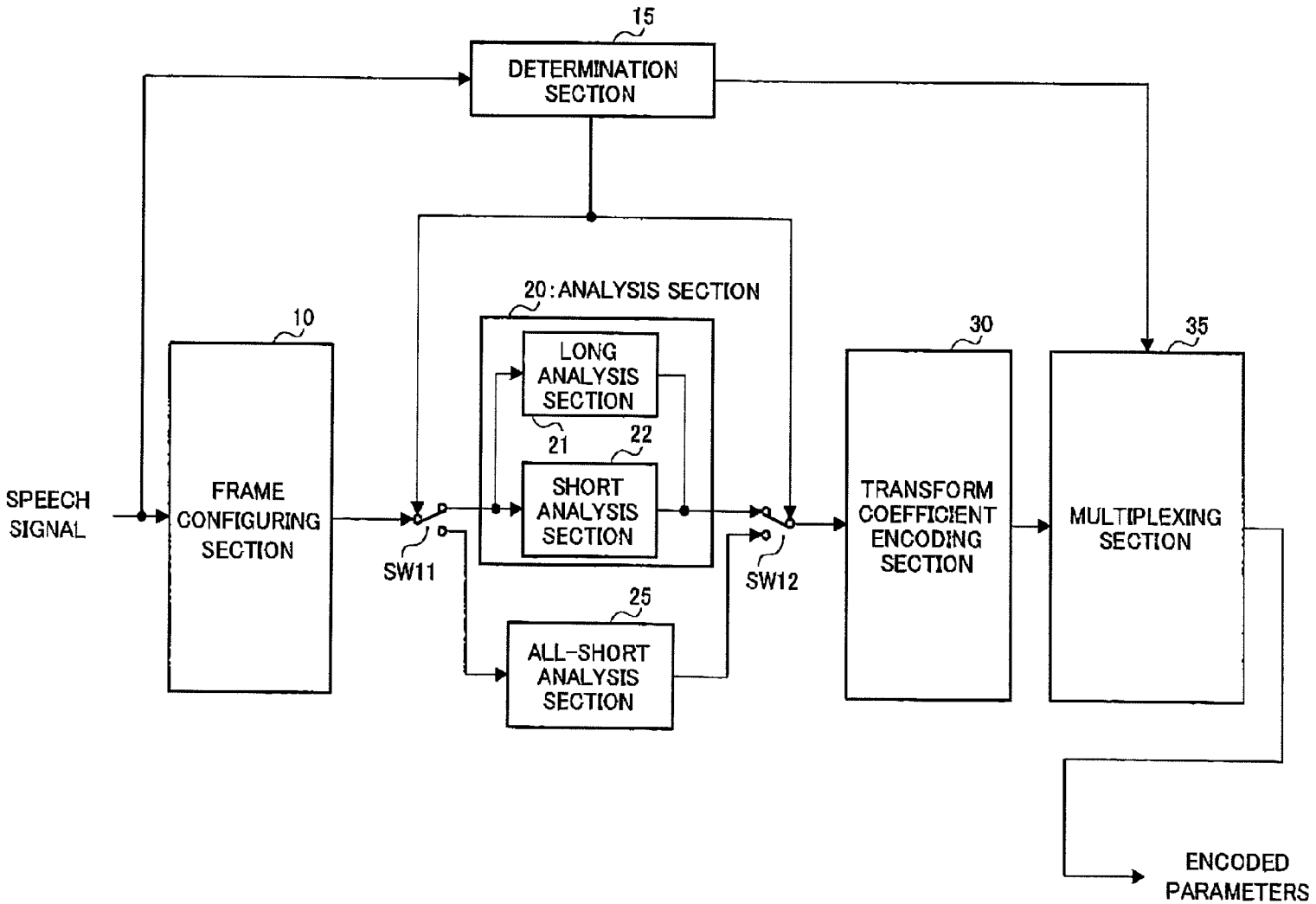
FIG. 13 is a block diagram showing the configuration of a speech encoding apparatus according to Embodiment 2 of the present invention.

The configuration of a speech encoding apparatus according to Embodiment 2 of the present invention is shown in FIG. 13. As shown in the drawing, the speech encoding apparatus according to the present embodiment having the configuration (FIG. 4) in Embodiment 1 further includes determination section 15, multiplexing section 35, SW (switch) 11 and SW12. In FIG. 13, components that are the same as those in FIG. 4 will be assigned the same reference numerals without further explanations. Although output to analysis section 20 from frame configuring section 10 and output to transform coefficient encoding section 30 from analysis section 20 are actually performed in a parallel manner as shown in FIG. 4, here, for convenience of graphical representation, each output is shown by a single signal line.

Determination section 15 analyzes the input speech signal and determines the characteristics of the signal. In characteristic determination, temporal variation of characteristics of the speech signal is monitored. When the amount of variation is less than a predetermined amount, it is determined to be a stationary portion, and, when the amount of change is greater than or equal to the predetermined amount, it is determined to be a non-stationary portion. The characteristics of the speech signal includes, for example, a short-term power or a short-term spectrum.

Determination section 15 then switches the analysis mode of MDCT analysis between the long-short combined analysis mode and the all-short analysis mode, according to a determination result. Thus, when the input speech signal is a stationary portion, determination section 15 connects SW11 and SW12 to the side of analysis section 20 and performs MDCT analysis in the long-short combined analysis mode using analysis section 20. On the other hand, when the input speech signal is a non-stationary portion, determination section 15 connects SW11 and SW12 to the side of all-short analysis section 25 and performs MDCT analysis in the all-short analysis mode using all-short analysis section 25. By this switching, when the speech signal is a stationary portion, the frame is analyzed using a combination of long analysis and short analysis, as in Embodiment 1, and, when the speech signal is a non-stationary portion, short analysis is repeatedly performed a plurality of times.

When the all-short analysis mode is selected by determination section 15, all-short analysis section 25 performs analysis by MDCT expressed by equation 5 using an analysis window expressed by equation 2 where the analysis window length is M2.

In addition, determination section 15 encodes determination information indicating whether the input speech signal is a stationary portion or a non-stationary portion, and outputs the encoded determination information to multiplexing section 35. The determination information is multiplexed with an encoded parameter to be outputted from transform coefficient encoding section 30 by multiplexing section 35 and outputted.

Figure 14:
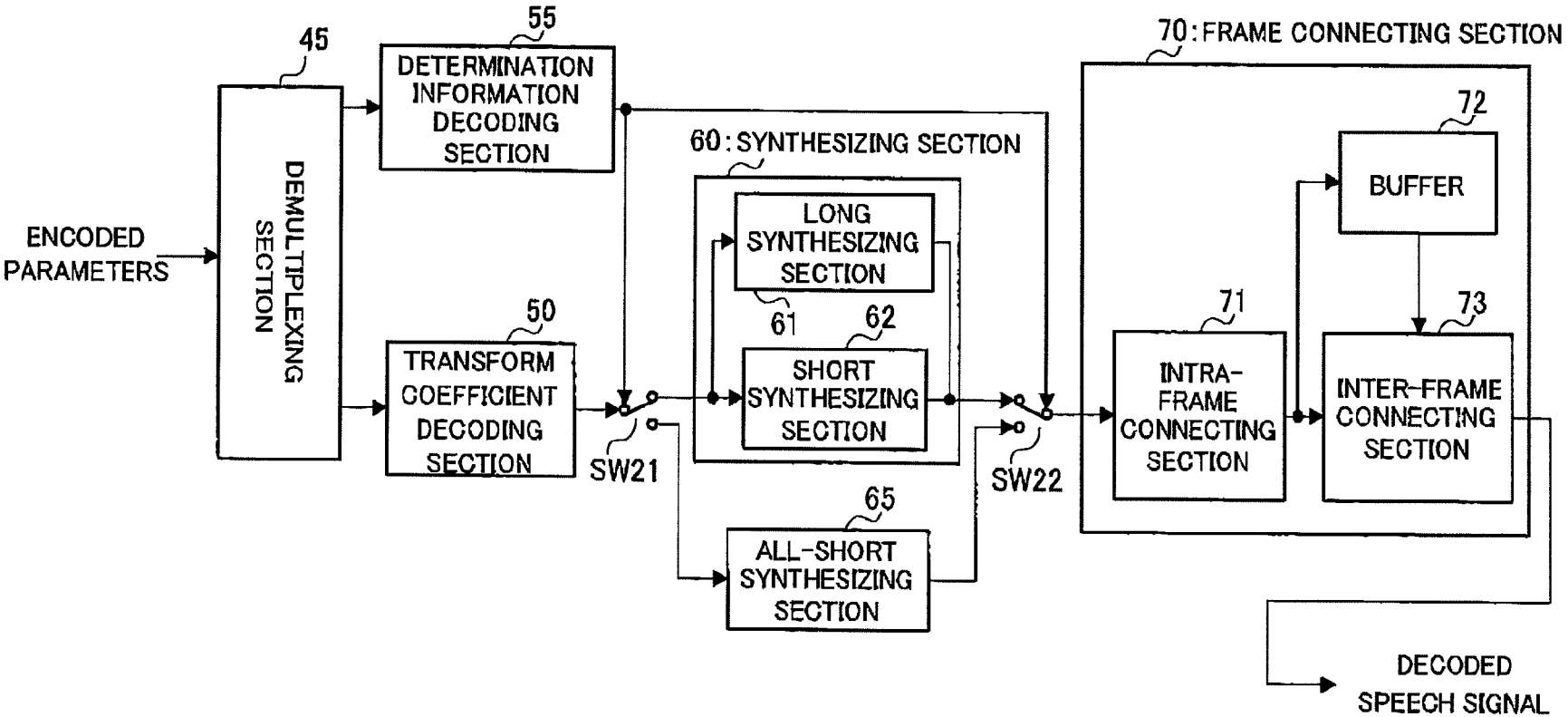
FIG. 14 is a block diagram showing the configuration of a speech decoding apparatus according to Embodiment 2 of the present invention.

The configuration of a speech decoding apparatus according to Embodiment 2 of the present invention is shown in FIG. 14. As shown in the drawing, the speech decoding apparatus according to the present embodiment having the configuration (FIG. 7) in Embodiment 1 further includes demultiplexing section 45, determination information decoding section 55, all-short synthesizing section 65, SW21 and SW22. In FIG. 14, components that are the same as those in FIG. 7 will be assigned the same reference numerals without further explanations. Although output to synthesizing section 60 from transform coefficient decoding section 50 and output to intra-frame connecting section 71 from synthesizing section 60 are actually performed in a parallel manner as shown in FIG. 7, here, for convenience of graphical representation, each output is shown by a single signal line.

Demultiplexing section 45 separates encoded parameters to be inputted into an encoded parameter indicating determination information and an encoded parameter indicating transform coefficients, and outputs the encoded parameters to determination information decoding section 55 and transform coefficient decoding section 50, respectively.

Determination information decoding section 55 decodes the inputted determination information. When the determination information indicates a stationary portion, determination information decoding section 55 connects SW21 and SW22 to the side of synthesizing section 60 and generates a synthesis signal using synthesizing section 60. Generation of a synthesis signal using synthesizing section 60 is the same as that described in Embodiment 1. On the other hand, when the determination information indicates a non-stationary portion, determination information decoding section 55 connects SW21 and SW22 to the side of all-short synthesizing section 65 and generates a synthesis signal using all-short synthesizing section 65. All-short synthesizing section 65 performs IMDCT processing on each of a plurality of decoded transform coefficients (short analysis) in one frame and generates a synthesis signal.

As described above, in the present embodiment, when, in one frame, an input speech signal is a stationary portion and stable, the speech signal of that frame is analyzed by a combination of long analysis and short analysis, and, when an input speech signal is a non-stationary portion (when the input speech signal rapidly changes), the speech signal of that frame is analyzed by short analysis to improve the time resolution, so that it is possible to perform optimal MDCT analysis according to the characteristics of the input speech signal, and, even when the characteristics of the input speech signal change, maintain good speech quality.

In the present embodiment, the overlapping period in the long-short combined analysis mode is the same as the overlapping period in the all-short analysis mode. Thus, there is no need to use an analysis frame for transition, such as LONG_START_WINDOW or LONG_STOP_WINDOW, described in ISO/IEC IS 13818-7 Information technology—Generic coding of moving pictures and associated audio information—Part 7: Advanced Audio Coding (AAC), for example.

For another method of determining between the long-short combined analysis mode and the all-short analysis mode, there is a method in which such determination is made according to the SNR of the signal located at a portion connected to a subsequent frame with respect to the original signal. By using this determination method, the analysis mode of the subsequent frame can be determined according to the SNR of the connecting portion, so that the misdetermination of the analysis mode can be reduced.

The above-described embodiments can be applied to an extension layer of layered encoding where the number of layers is two or more.

The speech encoding apparatus and the speech decoding apparatus according to the embodiments can also be provided to a radio communication apparatus such as a radio communication mobile station apparatus and a radio communication base station apparatus used in a mobile communication system.

In the above embodiments, the case has been described as an example where the present invention is implemented with hardware, the present invention can be implemented with software.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

The present application is based on Japanese Patent Application No. 2004-311143, filed on Oct. 26, 2004, the entire content of which is expressly incorporated by reference herein.

INDUSTRIAL APPLICABILITY

The present invention can be applied to a communication apparatus such as in a mobile communication system and a packet communication system using the Internet Protocol.

The invention claimed is:

1. A speech encoding apparatus for block-wise encoding a time domain speech signal, the speech encoding apparatus comprising:

an analyzer, including a processor, that performs MDCT analysis on one block of the time-domain speech signal by both a long analysis length frame and a short analysis length frame with each block, and obtains transform coefficients for the long analysis length frame and transform coefficients for the short analysis length frame in a frequency domain every block;

an encoder that encodes each of the transform coefficients for the long analysis length frame and the transform coefficients for the short analysis length frame; and an outputter that multiplexes encoded parameters obtained by the encoder and transmits the multiplexed parameters to the speech decoding apparatus;

wherein the encoder encodes the transform coefficients for the short analysis length frame using more bits per transform coefficient than used by the encoder for encoding the transform coefficients for the long analysis length frame, the long analysis length frame accounts for one of a start side period and an end side period on the each block, the short analysis length frame is shorter than the long analysis length and accounts for the other of the start side period and the end side period on the each block, an overlapping period of the long analysis length frame and the short analysis length frame is a half length of the short analysis length frame, without use of an analysis frame for transition.

2. The speech encoding apparatus according to claim 1, further comprising:

a determiner that determines whether the speech signal is a stationary portion or a nonstationary portion; and a second analyzer that repeats MDCT analysis on the one block a plurality of times by the short analysis length frame, when the speech signal is the non-stationary portion.

3. A radio communication mobile station apparatus comprising the speech encoding apparatus according to claim 1.

4. A radio communication base station apparatus comprising the speech encoding apparatus according to claim 1.

5. A speech encoding method for block-wise encoding a time domain speech signal, the speech encoding method comprising:

performing MDCT analysis, using an analyzer including a processor, on one block of the time-domain speech signal by both a long analysis length frame and a short analysis length frame with each block, and obtaining transform coefficients for the long analysis length frame and transform coefficients for the short analysis length frame in a frequency domain every block;

encoding, using an encoder, the transform coefficients for the long analysis length frame and the transform coefficients for the short analysis length frame, and multiplexing encoded parameters obtained by the encoder and transmitting the multiplexed parameters to the speech decoding apparatus;

wherein encoding the transform coefficients for the short analysis length uses more bits per transform coefficient than used by the encoder for encoding the transform coefficients for the long analysis length, the long analysis length frame accounts for one of a start side period and an end side period on the each block, the short analysis length frame is shorter than the long analysis length and accounts for the other of the start side period and the end side period on the each block, and an overlapping period of the long analysis length frame and the short analysis length frame is a half length of the short analysis length frame, without use of an analysis frame for transition.

* * * * *